US006969955B2

(12) United States Patent
Erickson et al.

(10) Patent No.: US 6,969,955 B2
(45) Date of Patent: Nov. 29, 2005

(54) METHOD AND APPARATUS FOR DIMMING CONTROL OF ELECTRONIC BALLASTS

(75) Inventors: James A. Erickson, Lincoln, NE (US); Mark B. Gruenewald, Omaha, NE (US); Kipton P. Hirschbach, Omaha, NE (US)

(73) Assignee: Axis Technologies, Inc., Lincoln, NE (US)

( * ) Notice: Subject to any disclaimer, the term of this patent is extended or adjusted under 35 U.S.C. 154(b) by 0 days.

(21) Appl. No.: 10/707,982

(22) Filed: Jan. 29, 2004

(65) Prior Publication Data

US 2005/0168154 A1 Aug. 4, 2005

(51) Int. Cl.[7] ..... H05B 37/02

(52) U.S. Cl. ..... 315/159; 315/DIG. 4; 315/291; 315/312

(58) Field of Search ..... 315/159, 149, 315/150–158, DIG. 4, 291, 307, 311, 324, 315/320

(56) References Cited

U.S. PATENT DOCUMENTS

| | | | |
|---|---|---|---|
| 3,931,695 | A | 1/1976 | Widmayer |
| 4,163,925 | A | 8/1979 | Gyursanszky |
| 4,207,497 | A | 6/1980 | Capewell et al. |
| 4,234,820 | A | 11/1980 | Widmayer |
| 4,350,933 | A | 9/1982 | Agarwala et al. |
| 4,352,045 | A | 9/1982 | Widmayer |
| 4,353,009 | A | 10/1982 | Knoll |
| 4,370,600 | A | 1/1983 | Zansky |
| RE31,146 | E | 2/1983 | Gyursanszky |
| 4,371,812 | A | 2/1983 | Widmayer |
| 4,392,087 | A | 7/1983 | Zansky |
| 4,523,131 | A | 6/1985 | Zansky |
| 4,663,570 | A | 5/1987 | Luchaco et al. |

(Continued)

FOREIGN PATENT DOCUMENTS

| | | | |
|---|---|---|---|
| EP | 0208083 | B1 | 1/1991 |

(Continued)

OTHER PUBLICATIONS

Rahman, S.; Callwood, C. (Virginia Polytechnic Inst. and State Univ., Bradley Dept. of Electrical Engineering, Blacksburg, VA United States); A Study Of The Ecological Efficiency Of New Electrical Technologies; *Energy Science and Technology*, pp. 733-739 (781 pages total); Published 1998, Oxford, United Kingdom; Publisher: Elsevier Science Ltd.

(Continued)

*Primary Examiner*—Tuyet Thi Vo
(74) *Attorney, Agent, or Firm*—Blackwell Sanders Peper Martin LLP

(57) ABSTRACT

An apparatus and method for providing dimming control of an electronic ballast circuit that includes a electronic ballast circuit that is electrically connected to a plurality of input voltage terminals that can receive alternating current and the electronic ballast circuit is electrically connected to the plurality of fluorescent lamp terminals. There is at least one light sensor that is electrically connected to the electronic ballast circuit so that the electrical power applied at the plurality of fluorescent lamp terminals can be proportionally modified in relationship to the ambient light received by the at least one light sensor. Also, there is a plurality of switches that are electrically connected in one-to-one corresponding relationship to a plurality of resistive loads so that the electrical power applied at the plurality of fluorescent lamp terminals can be set at a plurality of predetermined lighting levels.

23 Claims, 4 Drawing Sheets

U.S. PATENT DOCUMENTS 4,716,343 A 12/1987 Lindquist
4,766,352 A 8/1988 Widmayer
4,874,989 A 10/1989 Nilssen
4,894,587 A 1/1990 Jungreis et al.
4,933,605 A 6/1990 Quazi et al.
4,998,046 A 3/1991 Lester
5,039,914 A 8/1991 Szuba
5,084,653 A 1/1992 Nilssen
5,101,142 A 3/1992 Chatfield
5,118,992 A 6/1992 Szuba
5,165,053 A 11/1992 Jones
5,172,034 A 12/1992 Brinkerhoff
5,192,896 A 3/1993 Qin
5,198,726 A 3/1993 Van Meurs et al.
5,212,427 A 5/1993 Jones
5,245,253 A 9/1993 Quazi
5,438,239 A 8/1995 Nilssen
5,446,342 A 8/1995 Nilssen
5,483,127 A 1/1996 Widmayer et al.
5,539,284 A 7/1996 Stone
5,612,594 A 3/1997 Maheshwari
5,612,595 A 3/1997 Maheshwari
5,663,613 A * 9/1997 Yamashita et al. ..... 315/308
5,742,131 A 4/1998 Sprout et al.
5,866,993 A 2/1999 Moisin
5,892,330 A 4/1999 Widmayer
6,051,938 A 4/2000 Arts et al.
6,121,734 A 9/2000 Szabados
6,181,072 B1 1/2001 Leslie et al.
6,218,787 B1 4/2001 Murcko et al.
6,218,788 B1 4/2001 Chen et al.
6,223,071 B1 4/2001 Lundahl et al.
6,339,298 B1 1/2002 Chen
6,351,080 B1 2/2002 Birk et al.
6,429,602 B1 8/2002 Takahashi et al.
6,452,344 B1 9/2002 MacAdam et al.
6,486,615 B2 11/2002 Hui et al.
6,495,964 B1 * 12/2002 Muthu et al. ..... 315/149
6,525,479 B1 2/2003 Keggenhoff et al.
6,538,395 B2 3/2003 Szabados
6,555,966 B2 4/2003 Pitigoi
6,583,573 B2 6/2003 Bierman
6,603,274 B2 8/2003 Ribarich et al.
6,614,013 B2 9/2003 Pitigoi-Aron et al.
2002/0014861 A1 2/2002 Hui
2002/0017881 A1 2/2002 Szabados
2002/0140373 A1 10/2002 Ribarich
2002/0141129 A1 10/2002 Ribarich
2003/0080696 A1 5/2003 Tang

FOREIGN PATENT DOCUMENTS

EP 0416697 B1 7/1995
EP 0432845 B1 11/1995
EP 1209954 A1 5/2002
EP 0818129 B1 6/2003
EP 1120022 B1 8/2003
WO PCT/US96/17281 7/1997
WO PCT/CA99/00964 4/2000
WO PCT/US02/08995 10/2002
WO PCT/US02/10067 10/2002

OTHER PUBLICATIONS

Bierman, A.; Conway, K.M.; Characterizing Daylight Photosensor System Performance To Help Overcome Market Barriers; *Journal of the Illuminating Engineering Society*, vol. 29, No. 1, pp. 101-115; Published Winter 2000, USA; Publisher: Illuminating Eng. Soc. North America.

* cited by examiner

METHOD AND APPARATUS FOR DIMMING CONTROL OF ELECTRONIC BALLASTS

BACKGROUND OF INVENTION

One significant problem is that the energy costs for lighting appear to be increasing. This is due to the significant expenditures required for electricity generation plants and the associated environmental problems. The Energy Policy Act of 2002 as well as efficiency standards such as ASHRAE/IESNA 90.1 and California Title 24 now mandate significant lighting power reductions. A major issue is that there still needs to be sufficient lighting to promote safety and avoid excessive strain on the eyes. The amount of ambient lighting that is currently available is typically not considered when determining the amount of energy to utilize in supplying electrical lighting. Also, there are environmental issues associated with the disposal of burnt-out fluorescent lamps. It would be very beneficial to increase the life of a fluorescent lamp to lessen this environmental problem. Also, organizations that do not attempt to reduce their energy consumption are at a competitive disadvantage with respect to organizations that reduce their energy use due to the tax credits that are now currently available.

The present invention is directed to overcoming one or more of the problems set forth above.

SUMMARY OF INVENTION

In one aspect of this invention, an apparatus for providing dimming control of an electronic ballast circuit is disclosed. This apparatus includes a plurality of input terminals that can receive alternating current, a plurality of fluorescent lamp terminals, an electronic ballast circuit, wherein the electronic ballast circuit is electrically connected to the plurality of input terminals that can receive alternating current and the electronic ballast circuit is electrically connected to the plurality of fluorescent lamp terminals, at least one light sensor that is electrically connected to the electronic ballast circuit so that the electrical power applied at the plurality of fluorescent lamp terminals can be proportionally modified in relationship to the ambient light received by the at least one light sensor, and a plurality of switches that are electrically connected in one-to-one corresponding relationship to a plurality of resistive loads, wherein the plurality of switches and the plurality of resistive loads are electrically connected to the electronic ballast circuit so that the electrical power applied at the plurality of fluorescent lamp terminals can be set at a plurality of predetermined lighting levels.

In another aspect of this invention, a method for providing dimming control of an electronic ballast circuit is disclosed. This method includes applying alternating current to a plurality of input terminals that are electrically connected to an electronic ballast circuit, receiving ambient light with at least one light sensor that is electrically connected to the electronic ballast circuit, and altering an amount of electrical power applied to the electronic ballast circuit through selective activation of at least one of a plurality of switches that are electrically connected in oneto-one corresponding relationship to a plurality of resistive loads and to the electronic ballast circuit, wherein the electronic ballast circuit is electrically connected to a plurality of fluorescent lamp terminals that are capable of lighting at least one fluorescent lamp.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures and compartments have not been described in detail so as to obscure the present invention.

For the present invention, there are a wide variety of ballast circuits that can suffice. Nonlimiting and illustrative examples can include those manufactured by STMicroelectronics having a place of business at 39, Chemin du Champ des Filles, C. P. 21, CH 1228 Plan-Les-Ouates, Geneva, Switzerland.

Figure 1:
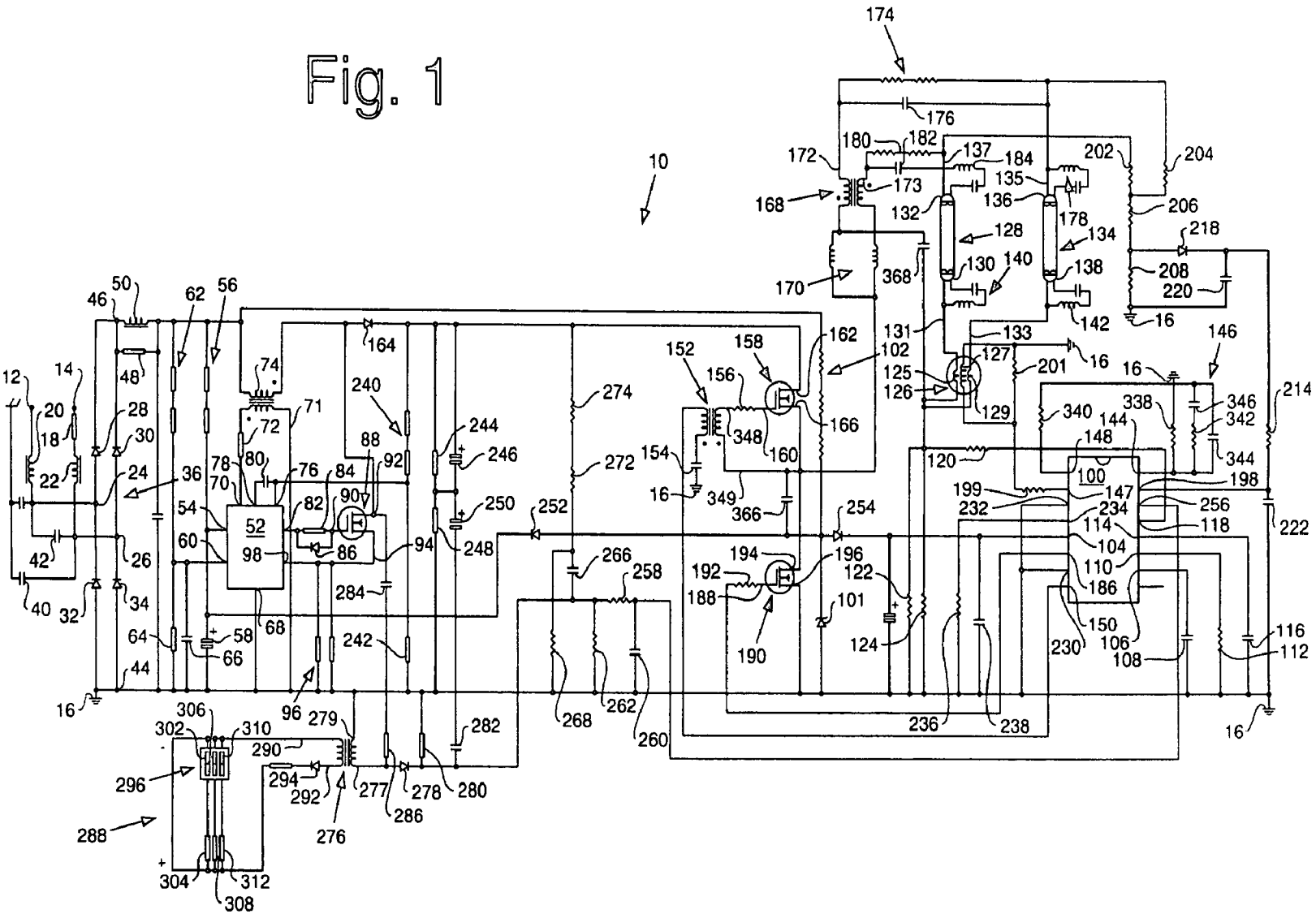
FIG. 1 is an electrical schematic of a dimmable ballast circuit, a light sensor and a plurality of switches in accordance with the present invention.

Referring now to FIG. 1, an illustrative, but nonlimiting, the ballast circuit and associated components of the present invention are generally indicated by numeral 10. The voltage supply is preferably, but not necessarily, one hundred and twenty (120) volts. The first input voltage terminal 12 supplies voltage via a first inductor 20, e.g., 10 mH, which is electrically connected to a first input 24 for a rectifying bridge that is generally indicated by numeral 36. The second input voltage terminal 14 supplies voltage via a fuse 18, e.g., rated at 3 amperes and 300 volts. This fuse 18 is electrically connected to a second inductor 22, e.g., 10 mH, which electrically connected to a second input 26 for the rectifying bridge 36. The rectifying bridge 36 includes a series of four diodes including a first diode 28, a second diode 30, a third diode 32 and a fourth diode 34, respectively, e.g., 1N4007.

The ground or neutral as indicated by numeral 16 is connected to the first input 24 for the rectifying bridge 36 via a first capacitor 38, e.g., 1,000 pF. Also, the ground 16 is connected to the second input 26 for the rectifying bridge 36 via a second capacitor 40, e.g., 1,000 pF. Positioned between the two input voltage terminals 12 and 14 and after the output of the first inductor 20 and the output of the second inductor 22 is a third capacitor 42, e.g., 0.33 $\mu$F. The first output 44 for the rectifying bridge 36 is connected to ground 16 and the second output 46 for the rectifying bridge 36 is connected to a first resistor 48, e.g., 1,000 Ω, and a third inductor 50, e.g., 1 mH. The first resistor 48 and the third inductor 50 are electrically connected in parallel to each other.

Voltage is supplied from the rectifying bridge 36 to driver and control circuits for a power factor corrector circuit 52 via voltage input 54 through a first pair of resistors 56, e.g., 100,000 Ω, which are electrically connected in series. An illustrative, but nonlimiting example of a power factor corrector circuit 52 includes an integrated circuit designated by "L6561" manufactured by STMicroelectronics having a place of business at 39, Chemin du Champ des Filles, C. P. 21, CH 1228 Plan-Les-Ouates, Geneva, Switzerland. The voltage input 54 is also connected to ground 16 via a fourth capacitor 58, e.g., 22 $\mu$F.

A rectified voltage signal is that is proportional to the rectified voltage from the rectifying bridge 36 is applied as the input 60 to the multiplier stage of the power factor corrector circuit 52. Voltage is supplied from the rectifying bridge 36 to a second pair of resistors 62, e.g., 910,000 Ω, which are electrically connected in series. The input 60 to the multiplier stage of the power factor corrector circuit 52 is also connected to ground 16 via a second resistor 64, e.g., 8,200 Ω, and a fifth capacitor 66, e.g., 0.015 $\mu$F. The second resistor 64 and the fifth capacitor 66 are electrically connected in parallel. Input 68 to the power factor corrector integrated circuit 52 is electrically connected directly to ground 16.

There is a zero current detector input 70 for the power factor corrector circuit 52 that is connected in series to a third resistor 72, e.g., 22,000 Ω. The third resistor 72 is then electrically connected in series to an inductive dual coil transformer 74, e.g., 1.1 mH. The other input 71 to the inductive dual coil transformer 74 is electrically connected to ground 16. When there is zero current flowing into the zero current detector input 70, this will shut down the power factor corrector circuit 52.

There is an output for the error amplifier 78 and an inverting input for the error amplifier 76 associated with the power factor corrector circuit 52. A feedback circuit is located between the output of the error amplifier 78 and an inverting input for the error amplifier 76, which includes a sixth capacitor 80, e.g., 0.47 $\mu$F.

There is a gate driver output 82 from the power factor corrector circuit 52 that provides current to the gate 90 of a n-channel metal oxide semiconductor field effect transistor 88, e.g., 1RF840A, through a fourth resistor 84, e.g., 1,000 Ω, and a small signal diode 86, e.g., 1N4148. The fourth resistor 84 and the small signal diode 86 are electrically connected in parallel.

The output or source 94 from the a n-channel metal oxide semiconductor field effect transistor 88 can provide current to the input 98 to the comparator of the control loop for the power factor corrector circuit 52. The output or source 94 from the a n-channel metal oxide semiconductor field effect transistor 88 is connected to ground 16 via a third pair of resistors 96, e.g., 0.7 Ω, where the third pair of resistors 96 are electrically connected to each other in parallel.

The previously referenced inductive dual coil transformer 74 provides voltage to a circuit to drive and control fluorescent lighting 100 via a series of three resistors 102, e.g., 24,000 Ω, which are electrically connected in series. A nonlimiting, but illustrative example of this type of monolithic integrated circuit includes "FM2822" manufactured by Shanghai Fudan Microelectronics Co., Ltd. having a place of business at Floor 7th, Building C No. 668, Eastern Beijing Road, Shanghai, Peoples Republic of China. The series of three resistors 102 is electrically connected to the supply current input 104 for the drive and control circuit 100. Also, the series of three resistors 102 is electrically connected to a planar zenor diode 101, e.g., 2CW37-15A, Vz=13.8-14.9 V and Iz=5 mA. The planar zenor diode 101 is also connected to ground 16. The supply current input 104 for the drive and control circuit 100 operates to limit voltage and prevent undervoltage with a lockout function. There is a sixteenth capacitor 238, e.g., 0.22 $\mu$F, that is electrically connected to the supply current input 104 for the drive and control circuit 100 at one end and the other end is electrically connected to ground 16. There are two opposing rectifiers 252 and 254, e.g., 1N4007, respectively, electrically connected between the voltage input 54 to the multiplier stage of the power factor corrector circuit 52 and the supply current input 104 for the drive and control circuit 100.

There is a first external capacitor output 106 for the drive and control circuit 100 that is electrically connected to a seventh capacitor 108, e.g., 0.47 $\mu$F. This seventh capacitor 108 is electrically connected to ground 16 and sets a preheat timing wherein a small current is used to charge the first external capacitor output 106 so that the voltage on the first external capacitor output 106 increases gradually from 0 volts to 4 volts. When the voltage reaches 4 volts, the preheat timing is over. There is a multiplier, e.g., five (5)

times, of the amount of current that is applied to discharge the seventh capacitor 108, then the voltage sweeps down gradually to the point where a fluorescent lamp will be ignited. This period of time is called ignition time. At the end of ignition, the voltage at the first external capacitor output 106 is set to zero. A second function is to use the first external capacitor output 106 to set the stop timing duration when the open circuit lamp voltage exceeds a predetermined level during the ignition time. The stop timing duration is equal to a predetermined percentage, e.g., one-half, of the preheat time. This function only becomes active when the ignition voltage sweeps end but remains active after that point in time.

There is an external resistor output 110 for the drive and control circuit 100 that is electrically connected to a fifth resistor 112, e.g., 62,000 Ω. This fifth resistor 112 is electrically connected to ground 16. The fifth resistor 112 is electrically connected to the external resistor output 110 to set the preheat current. During preheat period, the voltage applied to this external resistor output 110 remains at 4 volts. After preheating, the voltage will sweep down to zero at a predetermined rate.

There is a second external capacitor output 114 for the drive and control circuit 100 that is electrically connected to a eighth capacitor 116, e.g., 100 pF. This eighth capacitor 116 is electrically connected to ground 16. The eighth capacitor 116 is precharged to a predetermined voltage during the start-up state.

There is an inductor current monitoring input 118 that is electrically connected to a sixth resistor 120, e.g., 18,000 Ω. The sixth resistor is connected in series to both the seventh resistor 122, e.g., 1 Ω and an eighth resistor 124, e.g., 1 Ω. The seventh resistor 122 and the eighth resistor 124 are electrically connected to each other in parallel and are both electrically connected to ground 16.

The sixth resistor 120 is also connected via a twenty-seventh capacitor 368, e.g., 0.01 μF, to a tri-coil transformer 126, e.g., MX2426 and 2.5 mH, to provide current to both a first fluorescent lamp 128 at a first fluorescent lamp terminal 130 for the a first fluorescent lamp 128 and a second fluorescent lamp 134 at a second fluorescent lamp terminal 138 for the second fluorescent lamp terminal 134. An illustrative, but nonlimiting, example of a first fluorescent lamp 128 and a second fluorescent lamp 134 includes a T8, four (4) foot fluorescent lamps that operate at 120 volts. However, numerous other types of fluorescent lamps may suffice for the present invention including, but not limited to, T12 fluorescent lamps.

There is a first electrical conductor 131 that is electrically connected between the first fluorescent lamp terminal 130 for the first fluorescent lamp 128 and a first coil 125 for the tri-coil transformer 126. This first electrical conductor 131 is electrically connected in parallel with a first combination inductor and capacitor 140, e.g., 50T/50T, 3.14 mH and 0.47 μF., that is electrically connected in series.

There is a second electrical conductor 133 that is electrically connected between the second fluorescent lamp terminal 138 for the second fluorescent lamp 134 and a third coil 129 for the tri-coil transformer 126. This second electrical conductor 133 is electrically connected in parallel with a second combination inductor and capacitor 142, e.g., 50T/50T, 3.14 mH and 0.47 μF., that is electrically connected in series.

Current that either flows from the third coil 129 for the tri-coil transformer 126 into the second fluorescent lamp terminal 138 for the second fluorescent lamp 134 and/or current that flows from the first coil 125 for the tri-coil transformer 126 into the first fluorescent lamp terminal 130 for the first fluorescent lamp 128 induces a current to flow from the second coil 127 for the tri-coil transformer 126 into a first differential input for sensing fluorescent lamp current 147 for the drive and control circuit 100 via a thirty-fourth resistor 199, e.g., 5,600 Ω. There is a thirty-fifth resistor 201, e.g., 12 Ω, that is electrically connected in series with the thirty-fourth resistor 199 and ground 16 and is electrically connected in parallel with the second coil 127 for the tri-coil transformer 126.

There is a lamp power output 144 that provides a current that represents the fluorescent lamp power into an external capacitor and resistor network 146. An illustrative, but nonlimiting example of an external capacitor and resistor network 146 includes a twenty-third capacitor 344, e.g., 0.022 μF, that is electrically connected in parallel with a thirty-sixth resistor 338, e.g., 12,000 Ω. The combination of twenty-third capacitor 344 and the thirty-sixth resistor 338 is electrically connected in parallel with a thirty-seventh resistor 340, e.g., 5,600 Ω. The combination of the twenty-third capacitor 344, the thirty-sixth resistor 338 and the thirty-seventh resistor 340 is electrically connected in parallel with a thirty-eighth resistor 342, e.g., 750 Ω, and a twenty-fourth capacitor 346, e.g., 0.68 μF. The thirty-eighth resistor 342 and the twenty-fourth capacitor 346 are electrically connected to each other in series. One end of the thirty-seventh resistor 340, the twenty-third capacitor 344, the twenty-fourth capacitor 346 and the thirty-eighth resistor 342 is connected to ground 16 while the other end of the thirty-seventh resistor 340 is electrically connected to a second differential input for sensing lamp current 148 for the drive and control circuit 100.

There is a first lamp driver output 150 for the drive and control circuit 100 that provides voltage via a first primary terminal 363 to a first lamp driver transformer 152, e.g., 50T/50T, 3.14 mH. The second primary terminal 364 of the first lamp driver transformer 152 is electrically connected in series to a ninth capacitor 154, e.g., 0.47 μF, and then to ground 16.

There is a ninth resistor 156, e.g., 22 Ω, connected in series between a first secondary terminal 348 for the first lamp driver transformer 152 and a gate 160 for a first lamp driver, metal-oxide-semiconductor, field effect transistor 158, e.g., IRF 830A. The drain 162 for the first lamp driver, metal-oxide-semiconductor, field effect transistor 158 is electrically connected via a first rectifier 164, e.g., HER 206, to the inductive dual coil transformer 74.

Voltage from the second secondary terminal 349 for the a first lamp driver transformer 152 and voltage from the source 166 of the a first lamp driver, metal-oxide-semiconductor field effect transistor 158 are provided to a lamp driver power transformer 168 via a pair of dual inductors 170, e.g., 5 mH, which are electrically connected in parallel. There is a twenty-fifth capacitor 366, e.g., 1,00 pF, that is electrically connected between the second secondary terminal 349 for the a first lamp driver transformer 152 and the two opposing rectifiers 252 and 254.

There is a first secondary terminal 172 for the lamp driver power transformer 168 that is electrically connected in series to a fourth pair of series connected resistors 174, e.g., 56,000 Ω each. There is a tenth capacitor 176, e.g., 0.1 μF, which is electrically connected in parallel with the fourth pair of series connected resistors 174. The fourth pair of series connected resistors 174 and the tenth capacitor 176 are then electrically connected directly to a first terminal 136 for the second fluorescent lamp 134 via a third electrical conductor 135. The third electrical conductor 135 is in parallel with a third inductor and capacitor series combination 178, e.g., 2.5 mH and 0.47 μF.

There is a second secondary terminal 173 for the lamp driver power transformer 168 that is electrically connected in series to a fifth pair of series connected resistors 180, e.g., 56,000 Ω and an eleventh capacitor 182, e.g. 0.1 μF. The fifth pair of series connected resistors 180 and the eleventh capacitor 182 are electrically connected in parallel to each other. The fifth pair of series connected resistors 180 and the eleventh capacitor 182 are electrically connected directly to a second terminal 132 for the first fluorescent lamp 128 via a fourth electrical conductor 137. The fourth electrical conductor 137 is in parallel with a fourth inductor and capacitor series combination 184, e.g., 2.5 mH and 0.47 μF.

There is a second lamp driver output 186 for the drive and control circuit 100 that provides voltage to a gate 188 for a second lamp driver, metal-oxide-semiconductor, field effect transistor 190, e.g., IRF 830, via a tenth resistor 192, e.g., 22 Ω that is electrically connected in series. The drain 194 for the second lamp driver, metal-oxide-semiconductor field effect transistor 190 is electrically connected to the source 166 for the first lamp driver, metal-oxide-semiconductor field effect transistor 158. The source 196 for the second lamp driver, metal-oxide-semiconductor field effect transistor 190 is electrically connected to ground 16.

There is a voltage load input 198 for the drive and control circuit 100 that has the dual purpose of detecting an over-voltage condition for the first and the second fluorescent lamps 128 and 134, respectively, during ignition, removal or failure as well sensing the voltage for the first and the second fluorescent lamps 128 and 134, respectively, during normal use.

Voltage from the second terminal 132 of the first fluorescent lamp 128 is electrically connected in series to an eleventh resistor 202, e.g., 120,000 Ω and the first terminal 136 of the second fluorescent lamp 134 is electrically connected in series to a twelfth resistor 204, e.g., 120,000 Ω. The eleventh resistor 202 and the twelfth resistor 204 are electrically connected in parallel to each other and electrically connected in series to a thirteenth resistor 206, e.g., 200,000 Ω, which in turn is electrically connected in series to a fourteenth resistor 208, 12,000 Ω. The fourteen resistor 208 is electrically connected to ground 16. The voltage across the fourteenth resistor 208 is applied to a second rectifier 218, e.g., RGP10J, that is electrically connected in parallel to a fourteenth capacitor 220, e.g., 0.22 μF. The current then passes in series through a fifteenth resistor 214, e.g., 150,000 Ω, into the voltage load input 198 for the drive and control circuit 100. The voltage load input 198 is also connected to ground 16 via a fifteenth capacitor 222, e.g., 0.015 μF.

When the voltage load input 198 for the drive and control circuit 100 receives an input current that exceeds a predetermined value, a stop timer is activated. If at the end of the timing period, if the predetermined input current is exceeded, the drive and control circuit 100 is switched into a standby state with the first lamp driver output 150 turned off and the second lamp driver output 186 turned on. The drive and control circuit 100 remains in the standby state when the input current to the voltage load input 198 drops below a predetermined valve. If the input current exceeds a predetermined value, then the drive and control circuit 100 is switched into a standby state immediately. The current into voltage load input 198 is a filtered DC signal with a maximum value that corresponds to the maximum voltage for the first fluorescent lamp 128 and the second fluorescent lamp 134 in a dimming state.

There is a ground function 230 and a end-of-life input 232 (which is a function that is not utilized) for the drive and control circuit 100 that are both electrically connected to ground 16. There is a external resistor input 234 for the drive and control circuit 100 that is electrically connected to an eighteenth resistor 236, e.g., 30,000 Ω, which is then electrically connected to ground 16. There is a sixth pair of series connected resistors 240, e.g., 430,000 Ω and 430,000 Ω, that is electrically connected between the first rectifier 164 and the sixth capacitor 80. The sixth capacitor 80 is also electrically connected to a nineteenth resistor 242, e.g., 430,000 Ω, which is electrically connected to ground 16.

Also, there is a twentieth resistor 244, e.g., 510,000 Ω, and a seventeenth capacitor 246, e.g., 47 μF, that are electrically connected in parallel at one end to the first rectifier 164 and at the other end are electrically connected to a twenty-first resistor 248, e.g., 510,000 Ω, and an eighteenth capacitor 250, e.g., 47 μF. The twenty-first resistor 248 and the eighteenth capacitor 250 are both electrically connected in parallel and to ground 16.

Dimming control is provided by applying voltage to the dimming input 256 for the drive and control circuit 100. A voltage above a predetermined upper level, e.g., four (4) volts, will be clamped down and maintained at that predetermined level for full brightness and above a predetermined lower level will also be kept at that lower predetermined level for full dim status while the altering of the voltage between the predetermined lower level and the predetermined upper level is directly proportionate to a desired amount of dimming.

The dimming input 256 for the drive and control circuit 100 is electrically connected to a twenty-second resistor 258, e.g., 100,000 Ω, and a nineteenth capacitor 260, e.g., 0.22 μF. The nineteenth capacitor 260 is electrically connected to ground 16. The twenty-second resistor 258 is electrically connected to a twenty-third resistor 262, e.g., 62,000 Ω. The twenty-third resistor 262 is electrically connected to ground 16. Moreover, the twenty-second resistor 258 is electrically connected to a twentieth capacitor 266, e.g., 0.22 μF. The twentieth capacitor 266 is electrically connected to a twenty-sixth resistor 268, e.g., 62,000 Ω. This twenty-sixth resistor 268 is electrically connected to ground 16. Moreover, this twenty-sixth resistor 268 is electrically connected in series to a twenty-seventh resistor 272, e.g., 330,000 Ω. The twenty-seventh resistor 272 is electrically connected in series to a twenty-eighth resistor 274, e.g., 330,000 Ω. The twenty-eighth resistor 274 is electrically connected to the first rectifier 164 and the drain 162 for the first lamp driver, metal-oxide-semiconductor, field effect transistor 158.

Dimming voltage is provided to dimming input 256 for the drive and control circuit 100 via the twenty-fifth resistor 268, the twentieth capacitor 266, the twenty-third resistor 262 and the twenty-second resistor 258 and the nineteenth capacitor 260 via a dimming voltage transformer 276, e.g., 10.5 mH and 30T/30T. The voltage from the dimming voltage transformer 276 passes through a second small signal diode 278, e.g., 1N4448. The second small signal diode 278 is electrically connected to the twentieth capacitor 266, the twenty-third resistor 262 and the twenty-second resistor 258. Furthermore, the second small signal diode 278 is electrically connected to a twenty-ninth resistor 280, e.g., 120,000 Ω and a twenty-first capacitor 282, e.g., 0.1 μF. The twenty-ninth resistor 280 and the twenty-first capacitor 282 are both electrically connected to ground 16.

Also, electrically connected to the first secondary output terminal 277 for the dimming voltage transformer 276 is the voltage from the drain 92 of a n-channel, metal oxide semiconductor, field effect transistor 88 that passes through a twenty-second capacitor 284, e.g., 1,000 pF, which is electrically connected in series with a thirtieth resistor 286, e.g., 120,000 Ω. The thirtieth resistor 286 is directly and electrically connected to the first secondary output terminal 277 for the dimming voltage transformer 276. The second secondary output terminal 279 for the dimming voltage transformer 276 is electrically connected to ground 16.

There is a light sensor 288 that provides voltage to the first primary input terminal 290 for the dimming voltage transformer 276 and to a second primary input terminal 292 for the dimming voltage transformer 276 via a third small signal diode 294, e.g., 1N4148. Current can be diverted to a series of switches 296. The preferred illustrative, but nonlimiting, example of a series of switches 296 includes three (3) dual-in-line package switches. A dual-in-line package switch or DIP switch is a group of subminiature switches mounted in a package compatible with standard integrated-circuit sockets and usually include rocker or slide-type switches. The slide type switches are preferred.

An illustrative, but nonlimiting, example of a light sensor 288 can be obtained from Shanghai Fudan Microelectronics Co., Ltd. having a place of business at Floor 7th, Building C, No. 668 Eastern Beijing Road, Shanghai, People's Republic of China. There are also numerous other devices that can be utilized to provide a voltage that is proportional to the ambient light. This includes, but is not limited to, a photocell, a photoresistor, a photodiode, a phototransistor, a bipolar phototransistor, a photosensitive field-effect transistor and a light activated silicon-controlled rectifier.

The series of switches 296 includes a first switch 302 that is electrically connected in series to a thirty-first resistor 304, e.g., 8,200 Ω. The first switch 302 is electrically connected to the first primary input terminal 290 for the dimming voltage transformer 276 and the thirty-first resistor 304 is electrically connected to the second primary input terminal 292, via the a third small signal diode 294, for the dimming voltage transformer 276 to divert current from the primary of the dimming voltage transformer 276.

The series of switches 296 also includes a second switch 306 that is electrically connected in series to a thirty-second resistor 308, e.g., 6,200 Ω. The second switch 306 is electrically connected to the first primary input terminal 290 for the dimming voltage transformer 276 and the thirty-second resistor 308 is electrically connected to the second primary input terminal 292, via the a third small signal diode 294, for the dimming voltage transformer 276 to divert current from the primary of the dimming voltage transformer 276.

Moreover, the series of switches 296 also includes a third switch 310 that is electrically connected in series to a thirty-third resistor 312, e.g., 4,700 Ω. The third switch 310 is electrically connected to the first primary input terminal 290 for the dimming voltage transformer 276 and the thirty-third resistor 312 is electrically connected to the second primary input terminal 292, via the a third small signal diode 294, for the dimming voltage transformer 276 to divert current from the primary of the dimming voltage transformer 276. However, numerous switches can be utilized for the series of switches 296 and the number of switches does not need to be limited to three (3).

Figure 2:
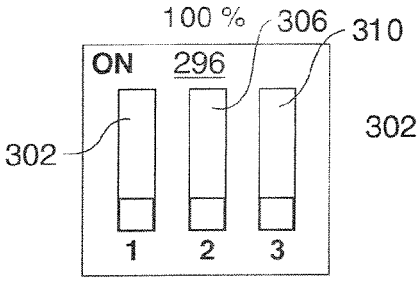
FIG. 2 is a enlarged representation of three (3) illustrative switches, e.g., dual in-line package switches, where the first switch is turned off, the second switch is turned off and the third switch is turned off to provide a one hundred percent (100%) lighting level in accordance with the present invention.

Referring now to FIG. 2 and the series of switches 296, when the first switch 302 is turned off, the second switch 306 is turned off and the third switch 310 is turned off, then all current will flow into the dimming voltage transformer 276 for one hundred percent (100%) of full light output from the first fluorescent lamp 128 and the second fluorescent lamp 134, respectively.

Figure 2A:
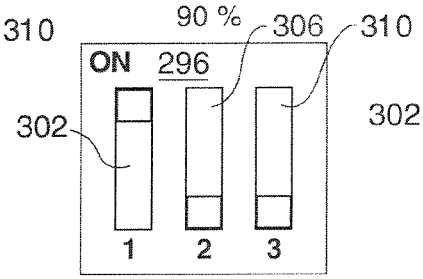
FIG. 2A is a enlarged representation of three (3) illustrative switches, e.g., dual in-line package switches, where the first switch is turned on, the second switch is turned off and the third switch is turned off to provide a ninety percent (90%) lighting level in accordance with the present invention.

Referring now to FIG. 2A and the series of switches 296, when the first switch 302 is turned on, the second switch 306 is turned off and the third switch 310 is turned off, then some current will flow through the first switch 302 and the thirty-first resistor 304 rather than the dimming voltage transformer 276 for ninety percent (90%) of full light output from the first fluorescent lamp 128 and the second fluorescent lamp 134, respectively.

Figure 2B:
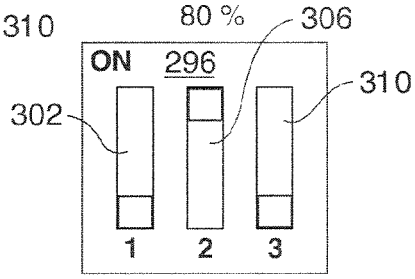
FIG. 2B is a enlarged representation of three (3) illustrative switches, e.g., dual in-line package switches, where the first switch is turned off, the second switch is turned on and the third switch is turned off to provide an eighty percent (80%) lighting level in accordance with the present invention.

Referring now to FIG. 2B and the series of switches 296, when the first switch 302 is turned off, the second switch 306 is turned on and the third switch 310 is turned off then some current will flow through the second switch 306 and the thirty-second resistor 308 rather than the dimming voltage transformer 276 for eighty percent (80%) of full light output from the first fluorescent lamp 128 and the second fluorescent lamp 134, respectively.

Figure 2C:
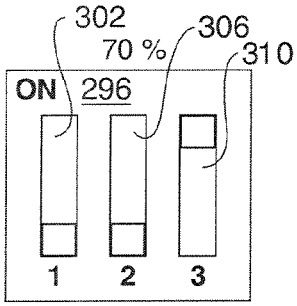
FIG. 2C is a enlarged representation of three (3) illustrative switches, e.g., dual in-line package switches, where the first switch is turned off, the second switch is turned off and the third switch is turned on to provide a seventy percent (70%) lighting level in accordance with the present invention.

Referring now to FIG. 2C and the series of switches 296, when the first switch 302 is turned off, the second switch 306 is turned off and the third switch 310 is turned on then some current will flow through the third switch 310 and the thirty-third resistor 312 rather than the dimming voltage transformer 276 for seventy percent (70%) of full light output from the first fluorescent lamp 128 and the second fluorescent lamp 134, respectively.

Figure 2D:
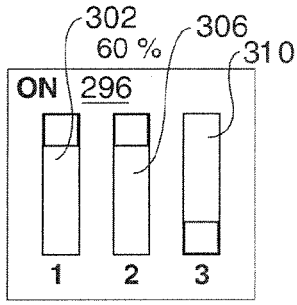
FIG. 2D is a enlarged representation of three (3) illustrative switches, e.g., dual in-line package switches, where the first switch is turned on, the second switch is turned on and the third switch is turned off to provide a sixty percent (60%) lighting level in accordance with the present invention.

Referring now to FIG. 2D and the series of switches 296, when the first switch 302 is turned on, the second switch 306 is turned on and the third switch 310 is turned off then some current will flow through the first switch 302 and the thirty-first resistor 304 as well as the second switch 306 and the thirty-second resistor 308 rather than the dimming voltage transformer 276 for sixty percent (60%) of full light output from the first fluorescent lamp 128 and the second fluorescent lamp 134, respectively.

Figure 2E:
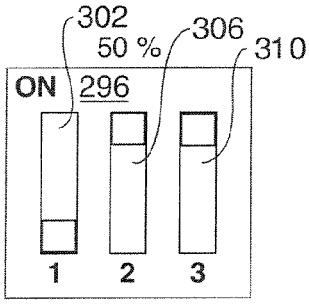
FIG. 2E is a enlarged representation of three (3) illustrative switches, e.g., dual in-line package switches, where the first switch is turned off, the second switch is turned on and the third switch is turned on to provide a fifty percent (50%) lighting level in accordance with the present invention.

Referring now to FIG. 2E and the series of switches 296, when the first switch 302 is turned off, the second switch 306 is turned on and the third switch 310 is turned on then some current will flow through the second switch 306 and the thirty-second resistor 308 as well as the third switch 310 and the thirty-third resistor 312 rather than the dimming voltage transformer 276 for fifty percent (50%) of full light output from the first fluorescent lamp 128 and the second fluorescent lamp 134, respectively.

Figure 2F:
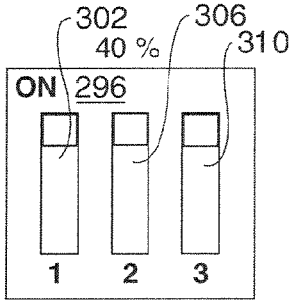
FIG. 2F is a enlarged representation of three (3) illustrative switches, e.g., dual in-line package switches, where the first switch is turned on, the second switch is turned on and the third switch is turned on to provide a forty percent (40%) lighting level in accordance with the present invention.

Referring now to FIG. 2F and the series of switches 296, when the first switch 302 is turned on, the second switch 306 is turned on and the third switch 310 is turned on then some current will flow through the first switch 302 and the thirty-first resistor 304, the second switch 306 and the thirty-second resistor 308 as well as the third switch 310 and the thirty-third resistor 312 rather than the dimming voltage transformer 276 for forty percent (40%) of full light output from the first fluorescent lamp 128 and the second fluorescent lamp 134, respectively.

Figure 3:
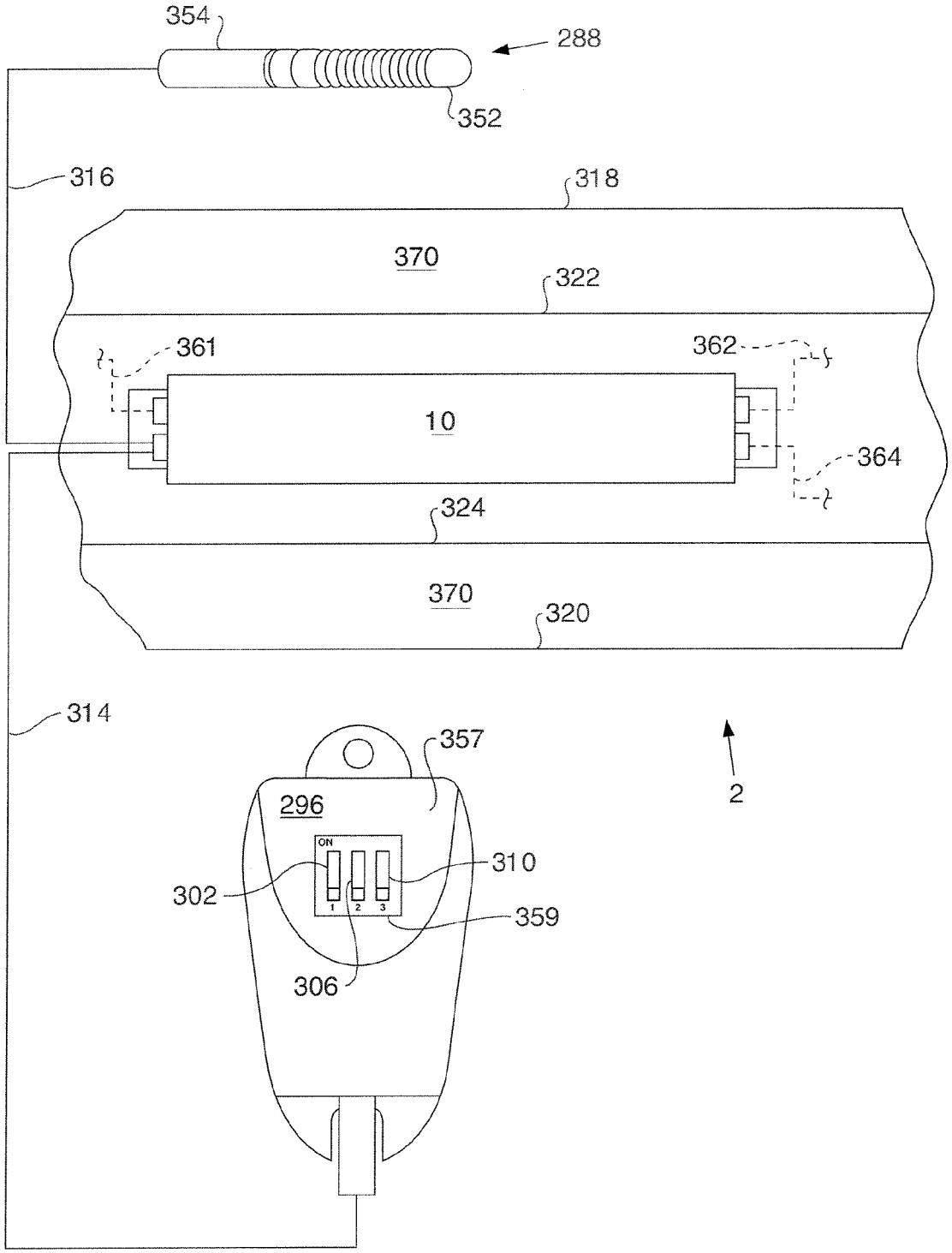
FIG. 3 is a basic electrical schematic that includes a ballast circuit in relationship to an outline of a fluorescent lighting fixture with wiring connections for receiving electrical power and providing electrical power to at least one fluorescent lamp, a light sensor and a representation of three (3) illustrative switches in accordance with the present invention.

The series of switches 296 are preferably DIP switches located within a molded housing, e.g., plastic, as shown in FIG. 3. Preferably, the molded housing 357 is of a "teardrop" shape. The series of switches 296, e.g., DIP switches, are preferably electrically attached to a small circuit board (not shown). The interior of the top section of the molded housing 357 preferably allows the series of switches 296 to snap in place for quick assembly with tabs (not shown) to guide a first electrical connector 314. The top section of the molded housing 357 has an opening 359 for providing access to the series of switches 296. The series of switches 296 provides manual ballast factor adjustment that is used to "tune" the output from the first fluorescent lamp 128 and the second fluorescent lamp 134.

Although the preferred range of predetermined light levels is from forty percent (40%) of full light output to about one hundred percent (100%) of full light output. However, the lower range can extend down to ten percent (10%) or less.

An advantage to the present invention is that each ballast circuit 10 can be individually controlled rather than having to collectively control the light level in the entire room. This means that the fluorescent lighting fixtures close to windows dim the same as the fluorescent fixtures in the back of a room. This will create uneven lighting. The present invention addresses this problem by dimming each fluorescent lighting fixture individually. Further, since each individual fluorescent lighting fixture can be pre-set, one or two fixtures in a room can be individually dimmed to a desired predetermined level, which is something that cannot be accomplished with whole-room controllers.

Referring again to FIG. 3, the overall wiring diagram for a fluorescent lighting fixture is generally indicated by numeral 2. This includes the previously described ballast circuit 10 with an electrical power conduits 361 that connect to of input voltage terminals 12 and 14, as shown in FIG. 1, that can receive alternating current. As shown in FIG. 3, there are electrical connectors 362 and 364 that electrically connect to the first fluorescent lamp 128 and the second fluorescent lamp 134, respectively, as shown in FIG. 1. There is also the first electrical connector 314 to the series of switches 296, e.g., DIP switch and a second electrical connector 316 to the light sensor 288, as shown in FIG. 3. A fluorescent light fixture is generally indicated by numeral 370. The first edge for a fluorescent light fixture is indicated by numeral 318 and a second edge for a fluorescent light fixture is indicated by numeral 320. The first edge for an internal cover for a fluorescent light fixture is indicated by numeral 322 and a second edge for an internal cover for a fluorescent light fixture is indicated by numeral 324.

Figure 4:
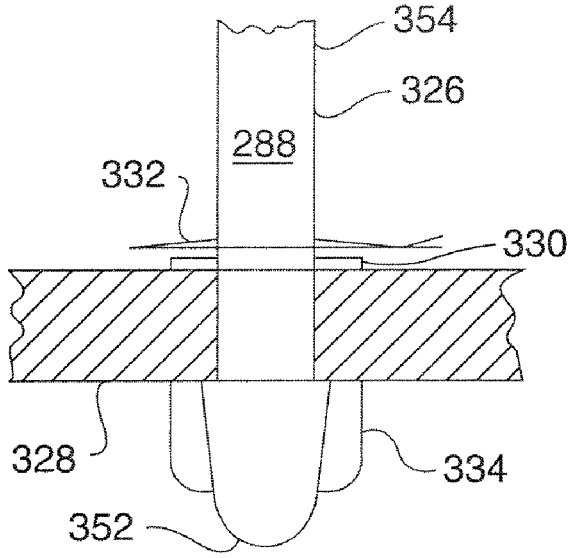
FIG. 4 is a perspective view of a light sensor, e.g., photocell, mounted on a recessed fixture in accordance with the present invention.

Referring now to FIG. 4, the light sensor 288, e.g., photocell, can be mounted to a recessed fluorescent light fixture 370, shown in FIG. 3, with the light sensor housing 326 extending through an acoustic tile 328. This is a flange nut 334 sealing the front of the light sensor housing 326 against the acoustic tile 328 with a washer 330 secured against the back of the acoustic tile 328 with a spring clip 332. This is to hold the light sensor housing 326 in a fixed position extending from the acoustic tile 328.

Figure 5:
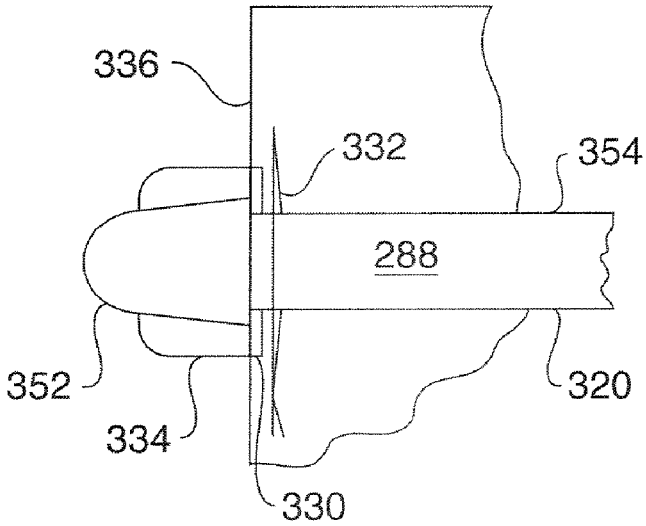
FIG. 5 is a perspective view of a light sensor, e.g., photocell, mounted on a surface fixture in accordance with the present invention.

Referring now to FIG. 5, the light sensor 288, e.g., photocell, can be mounted to a fluorescent light surface with the light sensor housing 326 extending through a fixture housing 336 for the fluorescent light fixture 370, shown in FIG. 3. There is a flange nut 334 sealing the front of the light sensor housing 326 against the fixture housing 336 with a washer 330 secured against the back of the fixture housing 336 with a spring clip 332. This is to hold the light sensor housing 326 in a fixed position extending from the fixture housing 336.

As shown in FIG. 3, the preferred, but nonlimiting, light sensor 288, e.g., photocell, includes a molded construction, e.g., molded plastic, with a removable dome lens 352, which is secured to a body 354. Preferably the light sensor 288 is secured within the dome lens 352 and the body 354 with a waterproof sealant, e.g., silicone (not shown). The shape of the dome lens 352 is designed for optimum spatial distribution for a cosine-corrected distribution of light to the light sensor 288. This is to maximize sensing accuracy of room light levels. The light sensor 288 responds to artificial and natural light sources with continuously responsive dimming.

The light sensor 288 measures light contribution available from natural sunlight entering the room and signals the ballast circuit 10 to dim to reduce artificial light output. Light levels are maintained by balancing natural light contribution with artificial light output. This technology is defined as "daylight harvesting," which is a helpful feature in reducing energy expenses associated with fluorescent lighting.

Although the preferred embodiment of the present invention and the method of using the same has been described in the foregoing specification with considerable details, it is to be understood that modifications may be made to the invention which do not exceed the scope of the appended claims and modified forms of the present invention incorporated by others skilled in the art to which the invention pertains will be considered infringements of this invention when those modified forms fall within the claimed scope of this invention.

What is claimed is:

1. An apparatus for providing dimming control of an electronic ballast circuit comprising:

a plurality of input voltage terminals that can receive alternating current;

a plurality of fluorescent lamp terminals;

an electronic ballast circuit, wherein the electronic ballast circuit is electrically connected to the plurality of input voltage terminals that can receive alternating current and the electronic ballast circuit is electrically connected to the plurality of fluorescent lamp terminals;

at least one light sensor that is electrically connected to the electronic ballast circuit so that electrical power applied at the plurality of fluorescent lamp terminals can be proportionally modified in relationship to the ambient light received by the at least one light sensor; and a plurality of switches that are electrically connected in one-to-one corresponding relationship to a plurality of resistive loads, wherein the plurality of switches and the plurality of resistive loads are electrically connected to the electronic ballast circuit so that the electrical power applied at the plurality of fluorescent lamp terminals can be set at a plurality of predetermined lighting levels.

2. The apparatus for providing dimming control of an electronic ballast circuit as set forth in claim 1, wherein the plurality of predetermined lighting levels can range from about forty percent (40%) to about one hundred percent (100%).

3. The apparatus for providing dimming control of an electronic ballast circuit as set forth in claim 1, wherein the plurality of predetermined lighting levels can range from about ten percent (10%) to about one hundred percent (100%).

4. The apparatus for providing dimming control of an electronic ballast circuit as set forth in claim 1, wherein the at least one light sensor includes a photocell.

5. The apparatus for providing dimming control of an electronic ballast circuit as set forth in claim 1, wherein the at least one light sensor is selected from the group consisting of a photoresistor, a photodiode, a phototransistor, a bipolar phototransistor, a photosensitive field-effect transistor and a light activated silicon-controlled rectifier.

6. The apparatus for providing dimming control of an electronic ballast circuit as set forth in claim 1, wherein the plurality of switches that are electrically connected in series in one-to-one corresponding relationship to the plurality of resistive loads, the combination of the plurality of switches and the plurality of resistive loads are electrically connected in parallel to the at least one light sensor and the at least one light sensor is electrically connected in parallel to the electronic ballast circuit.

7. The apparatus for providing dimming control of an electronic ballast circuit as set forth in claim 1, wherein the at least one light sensor includes a removable dome lens.

8. The apparatus for providing dimming control of an electronic ballast circuit as set forth in claim 1, further comprising a molded housing, wherein the plurality of switches, each of which is positioned within the molded housing.

9. The apparatus for providing dimming control of an electronic ballast circuit as set forth in claim 1, wherein the electronic ballast circuit includes a power factor correcting function.

10. The apparatus for providing dimming control of an electronic ballast circuit as set forth in claim 1, wherein the plurality of switches includes a plurality of dual-in-line package switches.

11. The apparatus for providing dimming control of an electronic ballast circuit as set forth in claim 10, wherein the plurality of dual-in-line switches includes at least three dual-in-line package switches.

12. The apparatus for providing dimming control of an electronic ballast circuit as set forth in claim 1, wherein the electronic ballast circuit includes a driver and control circuit for a plurality of fluorescent lamps.

13. The apparatus for providing dimming control of an electronic ballast circuit as set forth in claim 12, wherein the driver and control circuit provides closed loop control of current that is provided to the plurality of fluorescent lamps.

14. The apparatus for providing dimming control of an electronic ballast circuit as set forth in claim 11, wherein the driver and control circuit provides overvoltage protection for the plurality of fluorescent lamps.

15. A method for providing dimming control of an electronic ballast circuit comprising:

applying alternating current to a plurality of input voltage terminals that are electrically connected to an electronic ballast circuit;

receiving ambient light with at least one light sensor that is electrically connected to the electronic ballast circuit; and altering an amount of electrical power applied to the electronic ballast circuit through selective activation of at least one of a plurality of switches that are electrically connected in one-to-one corresponding relationship to a plurality of resistive loads and to the electronic ballast circuit, wherein the electronic ballast circuit is electrically connected to a plurality of fluorescent lamp terminals that are capable of lighting at least one fluorescent lamp.

16. The method for providing dimming control of an electronic ballast circuit as set forth in claim 15, wherein the electrical power applied to the plurality of fluorescent lamp terminals is inversely proportional to the amount of ambient light detected by the at least one light sensor.

17. The method for providing dimming control of an electronic ballast circuit as set forth in claim 15, wherein the at least one light sensor is selected from the group consisting of a photocell, a photoresistor, a photodiode, a phototransistor, a bipolar phototransistor, a photosensitive field-effect transistor and a light activated silicon-controlled rectifier.

18. The method for providing dimming control of an electronic ballast circuit as set forth in claim 15, further comprising utilizing a driver and control circuit of the electronic ballast circuit to provide closed loop control of the current that is applied to the plurality of fluorescent lamp terminals.

19. The method for providing dimming control of an electronic ballast circuit as set forth in claim 15, further comprising utilizing an overvoltage protection with the electronic ballast circuit.

20. The method for providing dimming control of an electronic ballast circuit as set forth in claim 15, further comprising utilizing a power correcting function with the electronic ballast circuit.

21. The method for providing dimming control of an electronic ballast circuit as set forth in claim 15, further comprising:

electrically connecting the plurality of switches that are electrically connected in series in one-to-one corresponding relationship to the plurality of resistive loads in parallel to the at least one light sensor; and electrically connecting in parallel the at least one light sensor to the electronic ballast circuit.

22. The method for providing dimming control of an electronic ballast circuit as set forth in claim 15, wherein the electrical power applied to the a plurality of fluorescent lamp terminals can be set at fixed predetermined levels through the selective activation of at least one of a plurality of switches.

23. The method for providing dimming control of an electronic ballast circuit as set forth in claim 22, wherein the fixed predetermined levels can range from about ten percent (10%) to about one hundred percent (100%).

* * * * *